United States Patent [19]

Whittaker

[11] 3,934,882

[45] Jan. 27, 1976

[54] GOLF GUIDE

[76] Inventor: Richard E. Whittaker, 302 S. Croton Ave., New Castle, Pa. 16103

[22] Filed: Dec. 11, 1974

[21] Appl. No.: 531,794

[52] U.S. Cl...... 273/183 A; 273/35 A; 273/186 C

[51] Int. Cl.[2]..... A63B 69/36

[58] Field of Search ..... 273/183, 186, 191, 192, 273/35, 32, 195, 196, 197, 198, 205, 33

[56] References Cited

UNITED STATES PATENTS

| | | | |
|---|---|---|---|
| 2,031,525 | 2/1936 | Clarke | 273/183 A X |
| 2,710,757 | 6/1955 | Chong | 273/183 A |
| 3,110,495 | 11/1963 | Carter | 273/35 A |
| 3,166,327 | 1/1965 | Champion | 273/183 A X |
| 3,194,565 | 7/1965 | Schroer | 273/186 R |

*Primary Examiner*—George J. Marlo
*Attorney, Agent, or Firm*—Webster B. Harpman

[57] ABSTRACT

A thin, flat member longer than its width has parallel sides and one end formed at a right angle thereto and notched midway between the sides, the other opposite end being pointed. A visible line is formed on the longitudinal axis and extends from the mid portion of the notch on the one end to the apex of the pointed end. The upper surface of the thin flat member is preferably reflective material which enables a golfer to see whether or not his head is over the ball and improves the golfer's view of club head movement after striking the ball. The notch forms a location for a golf ball. The flat member may be creased along its longitudinal axis to facilitate folding. In use the golf guide forms a visual path for the golf club after the golf ball is hit together with a transverse plane of reference for alignment with the head of a golf club when the golf ball is hit.

8 Claims, 3 Drawing Figures

GOLF GUIDE

BACKGROUND OF THE INVENTION

1. Field of the Invention

This invention relates to a golf guide such as employed to help a golfer guide the golf club toward and away from a golf ball.

2. Description of the Prior Art

Prior devices of this type have comprised tees with guiding arms thereon as in U.S. Pat. No. 1,761,532, flat tee supports useful in guiding a golf club toward a golf ball as in U.S. Pat. No. 2,461,601 and a device for aiding a golfer in guiding the club toward a ball which consists of a flat strip so positioned that the device acts to protect the ground and prevents the golfer from taking a divit before striking the ball.

This invention is primarily a device to help to golfer guide the club head away from the ball and align the club head at a precise right angle with respect to the desired path of the golf ball immediately before hitting the ball.

SUMMARY OF THE INVENTION

A golf guide device in the form of a flat, elongated member pointed at one end and notched at the other has a visual axial center line indicating the desired direction of a golf club and a golf ball hit thereby with the end of the device which is notched to locate the ball being formed at a right angle to form a transverse plane or line and preferably emphasized with which the head of the golf club can be aligned as it strikes the ball. Forming the uppermost surface of the guide of reflecting material lets the player see if his head is over the ball and the reflection of the club.

DESCRIPTION OF THE PREFERRED EMBODIMENT

Figure 1:
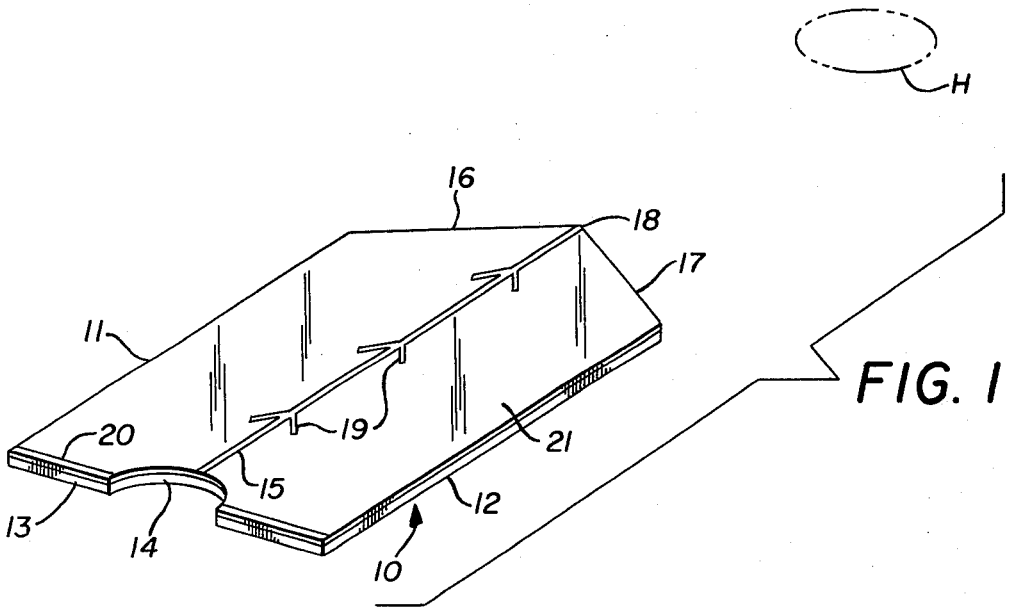
FIG. 1 is a perspective view of the golf guide with broken lines indicating a hole towards which a golf ball positioned adjacent the device is to be moved.

In the form of the invention chosen for illustration herein, the golf guide takes the form of a thin, flat member 10 having spaced parallel sides 11 and 12 and one end 13 formed at a right angle to the sides 11 and 12, the end 13 being notched as at 14. The notch is half circular and at its deepest point relative to the end 13 it lies on the longitudinal center line of the member 10 which is also visually indicated by a longitudinally extending stripe 15. The other and opposite end of the thin, flat member 10 is pointed by being formed of two angular portions 16 and 17 merging at their apex 18 which is also on the longitudinal center line of the member 10 and forms the terminal of the stripe 15. Diagrammatic arrow heads 19 are preferably formed along the stripe 15 in spaced relation to one another and a secondary stripe 20 is positioned on the upper surface of the member 10 in alignment with and immediately adjacent to the right angular end 13 of the device.

In the form of the invention chosen for illustration herein the uppermost surface of the member 10 is provided with a reflective surface 21, such as may be formed by a bright foil. The member 10 may be folded on a creased center line.

Still referring to FIG. 1 of the drawings, it will be seen that a bracket in the Figure includes a broken line representation of a hole H such as a hole in a green in a golf course and it will be seen that the golf guide as illustrated in FIG. 1 is positioned so that when a golf ball is positioned in the notch 14 or on a tee centered in the notch 14 the stripe 15 will extend from the golf ball toward the hole H and define a desired path for the golf club after striking the ball.

It will also be seen that the stripe 20 and the right angular end 13 of the golf guide form a transverse plane of reference with which the golfer can align the head of the golf club so that it is in a desired right angular plane with respect to the direction of movement of the golf ball as the club engages the golf ball. The golf ball will travel perpendicular to the plane of the golf club head.

The reflecting surface 21 enables a golfer to see whether or not his head is over the ball and it considerably improves the golfer's view of the path of the head of the golf club after it has engaged the golf ball which enables the golfer to visually determine just what path the club was following when it engaged the ball and whether or not the head of the club was at a right angle to the desired path.

Figure 2:
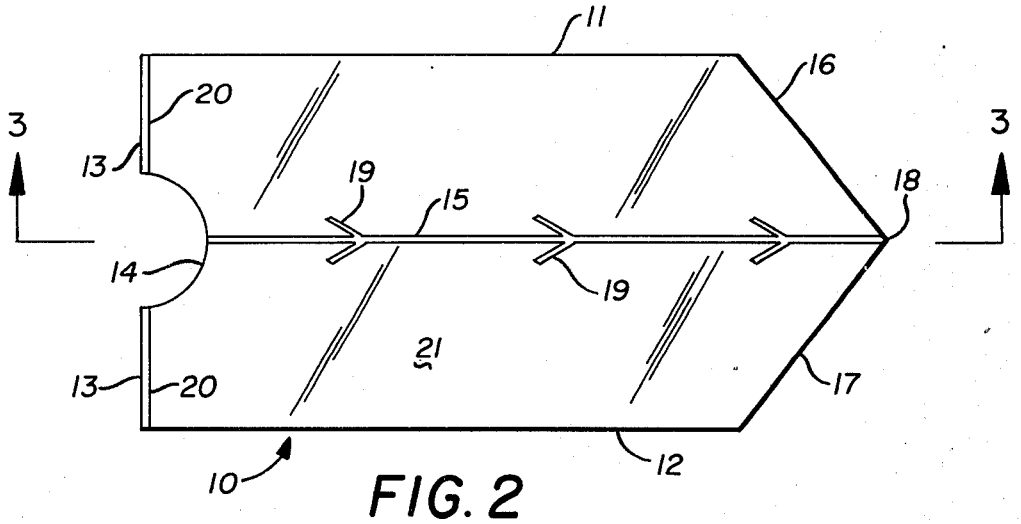
FIG. 2 is a top plan view of the golf guide seen in FIG. 1.

In FIG. 2 of the drawings, a top plan view of the golf guide is illustrated and by referring thereto it will be observed that the left end of the thin, flat member 10 is formed at a true right angle to each of the sides 11 and 12 of the member 10 and that the center or deepest portion of the notch 14 lies on the axial center line of the member 14 and is defined by the stripe 15 which extends to the apex 18 of the pointed other end of the device.

Figure 3:
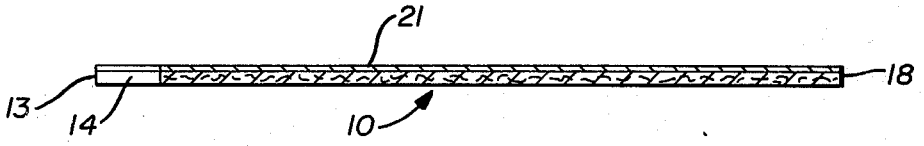
FIG. 3 is a longitudinal section on line 3—3 of FIG. 2.

In FIG. 3 of the drawings a longitudinal section on line 3—3 of FIG. 2 is shown and the reflective surface material indicated by 21 is shown in enlarged detail with respect to the material of the thin flat member 10 of which it forms a part.

Those skilled in the art will observe that the device can be formed of thin lightweight material such as paperboard or lightweight synthetic resin and that the reflective surface may be bright highly reflective foil or a similar reflective coating applied thereto while the stripes 15 and 20 may be superimposed thereon and be of a contrasting color or they may be printed on the foil or other surfacing material of the device as will occur to those skilled in the art.

It will thus be seen that a golf guide has been disclosed which differs from the structures heretofore proposed in the art primarily in that it provides a transverse plane of reference of substantial size extending on either side of the location of a golf ball so as to enable a golfer to align the head of the golf club therewith when it engages the golf ball, the transverse plane of reference being at right angles to the desired path of the golf ball and is automatically so positioned when the longitudinal center line of the device and the stripe 15 thereof is positioned between the ball and the hole towards which the ball is being moved and it will also be observed that the stripe 15 and the diagrammatic arrowheads 19 thereon indicate a desired path for both the golf ball and the golf club head and enable the golfer to visually determine just where the ball and the head of the club travel relative to the desired path.

Having thus described my invention what I claim is:

1. A golf guide consisting of a thin, flat member having spaced parallel sides and one end formed at a right angle with respect to said sides and notched on the axial center line of the member, the other end of the member being pointed with the apex of the point lying on said axial center line, a stripe on said member indicating said axial center line and extending between said notch and said apex of said pointed end.

2. The golf guide set forth in claim 1 and wherein the notch is half circular in shape and of a width such with that a golf ball can be positioned partially therein.

3. The golf guide set forth in claim 1 and wherein the notch is as wide as a golf ball and extends inwardly of the right angular end of said member a distance equal to one half the width of said golf ball.

4. The golf guide set forth in claim 1 and wherein a secondary stripe is provided on said member parallel with and immediately adajcent to said right angular end.

5. The golf guide set forth in claim 1 and wherein portions of said right angular end of said member extend outwardly and oppositely with respect to said notch so as to form a transverse plane with respect to the axial center line of said member.

6. The golf guide set forth in claim 1 and wherein the pointed end extends longitudinally outwardly of said member.

7. The golf guide set forth in claim 1 and wherein the thin flat member is creased so as to be foldable on its axial center line.

8. The golf guide set forth in claim 1 and wherein the upper surface of said thin, flat member is reflective.

* * * * *